US011688533B2

(12) United States Patent
Chang et al.

(10) Patent No.: US 11,688,533 B2
(45) Date of Patent: Jun. 27, 2023

(54) CHIP RESISTOR STRUCTURE

(71) Applicant: Cyntec Co., Ltd., Hsinchu (TW)

(72) Inventors: Hsiu-Yu Chang, Hsinchu (TW); Chao-Ting Lin, Hsinchu (TW)

(73) Assignee: CYNTEC CO., LTD., Hsinchu (TW)

( * ) Notice: Subject to any disclaimer, the term of this patent is extended or adjusted under 35 U.S.C. 154(b) by 0 days.

(21) Appl. No.: 17/517,144

(22) Filed: Nov. 2, 2021

(65) Prior Publication Data

US 2023/0134039 A1 May 4, 2023

(51) Int. Cl.
*H01C 1/142* (2006.01)
*H01C 7/00* (2006.01)

(52) U.S. Cl.
CPC ..... *H01C 1/142* (2013.01); *H01C 7/003* (2013.01)

(58) Field of Classification Search
CPC ..... H01C 7/003; H01C 1/142
See application file for complete search history.

(56) References Cited

U.S. PATENT DOCUMENTS 6,171,460 B1 * 1/2001 Bill ..... H01M 4/8605 204/291
6,201,290 B1 * 3/2001 Yamada ..... H01C 1/032 257/536
6,356,184 B1 * 3/2002 Doi ..... H01C 1/148 338/332
7,098,768 B2 * 8/2006 Doi ..... H01C 17/281 338/328
8,486,533 B2 * 7/2013 Boday ..... H05K 3/284 428/447
10,832,837 B2 * 11/2020 Shinoura ..... H01C 17/02
2004/0160303 A1 * 8/2004 Kuriyama ..... H01C 1/142 338/309
2008/0236873 A1 * 10/2008 Kuwajima ..... H01C 1/148 29/842
2014/0191841 A1 * 7/2014 Boday ..... H01C 1/028 427/101
2020/0328014 A1 * 10/2020 Shinoura ..... H01C 7/003

* cited by examiner

*Primary Examiner* — Kyung S Lee
(74) *Attorney, Agent, or Firm* — Kirton McConkie; Evan R. Witt

(57) ABSTRACT

A chip resistor structure includes a substrate; a pair of first electrodes disposed opposite to each other on a first surface of the substrate at a first interval; a resistance layer disposed between the pair of first electrodes on the first surface; a spacer layer made of a material having a composition different from that of the resistance layer, disposed over the pair of first electrodes; a protective layer overlying the resistance layer; and a plating layer electroplated onto the pair of first electrodes and the spacer layer, and having ends extending beyond the pair of first electrodes terminate at least over the spacer layer. The plating layer may be joined with or spaced from or climb up to the protective layer on or above the spacer layer.

17 Claims, 6 Drawing Sheets

CHIP RESISTOR STRUCTURE

FIELD OF THE INVENTION

The present invention relates to a resistor structure, and more particularly to a chip resistor structure.

BACKGROUND OF THE INVENTION

A chip resistor is a chip-type resistor. Due to its small size, high power, and low cost, a chip resistor can be used in a variety of electronic products. For example, chip resistors are commonly used in 3C (computer, communication, and consumer) electronics or automotive electronics, and suitably function for voltage drop and current limiting. When in use, the bottom side of the chip resistor is usually soldered to a circuit board, and on the top side, a resistance layer and a protective layer covering the resistance layer are formed through printing and drying sintering. The structure of a conventional chip resistor is shown in FIG. 1. The chip resistor includes a rectangular ceramic substrate 10, a pair of top electrodes 11 arranged opposite to each other on the top surface of the ceramic substrate 10 at a fixed interval, a pair of bottom electrodes 12 arranged opposite to each other on the bottom surface of the ceramic substrate 10 at a fixed interval, and a pair of end face electrodes 13, each of which electrically connects one of the top electrodes 11 to one of the bottom electrodes 12. The chip resistor further includes a plating layer 14 covering these electrodes 11, 12, and 13, a resistance layer 15 bridging the top electrodes 11, and a protective layer covering the resistance layer 15. The protective layer 15 is composed of a double-layer structure of a first insulating layer 161, which is so-called as an underplating layer and a second insulating layer 162, which is so-called as an overplating layer.

In general, inner electrodes of chip resistors, which include top electrodes, bottom electrodes and end face electrodes, are made of silver (Ag) paste. When an electronic device that includes such a chip resistor is used in an environment containing chemical substances that likely react with silver, the electrode would react with the chemical substances to form compounds with no or low conductivity. The chemical substances, for example, are high-permeability gases or vapors, such as hydrogen sulfide gas ($H_2S$), sulphur dioxide ($SO_2$), or moisture. In a common case, silver may react with sulfur (S) in the environment and transform into nonconductive silver sulfide ($Ag_2S$). Poor conduction or disconnection of the inner electrodes might happen. As such, the performance of the chip resistors would be adversely affected.

In addition, in a humid environment, water molecules may penetrate the electrode surface and be electrolyzed to produce hydrogen ions and hydroxide ions. With application of an electric field and at the presence of the hydroxide ions, silver atoms would be dissociated to produce silver ions, while migrating from a higher potential to a lower potential. Such silver migration phenomenon is likely to cause short-circuit problems.

Taking the chip resistor as shown in FIG. 1 as an example, the sulfide gas and moisture may penetrate into the chip resistor from a gap 17 existing between the insulating layer 162 and the plating layer 14 and cause the problems of sulfurated electrodes and silver migration.

SUMMARY OF THE INVENTION

Therefore, the present invention provides a chip resistor structure, which prevents from penetration of environmental chemicals so as to avoid sulfuration of electrodes as well as silver migration.

In an aspect of the present invention, a chip resistor structure includes a substrate; a pair of first electrodes disposed opposite to each other on a first surface of the substrate at a first interval; a resistance layer disposed between the pair of first electrodes on the first surface; a spacer layer made of a material having a composition different from that of the resistance layer, disposed over the pair of first electrodes; a protective layer overlying the resistance layer; and a plating layer electroplated onto the pair of first electrodes and the spacer layer, and having ends extending beyond the pair of first electrodes terminate at least over the spacer layer.

BRIEF DESCRIPTION OF THE DRAWINGS

The above contents of the present invention will become more readily apparent to those ordinarily skilled in the art after reviewing the following detailed description and accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
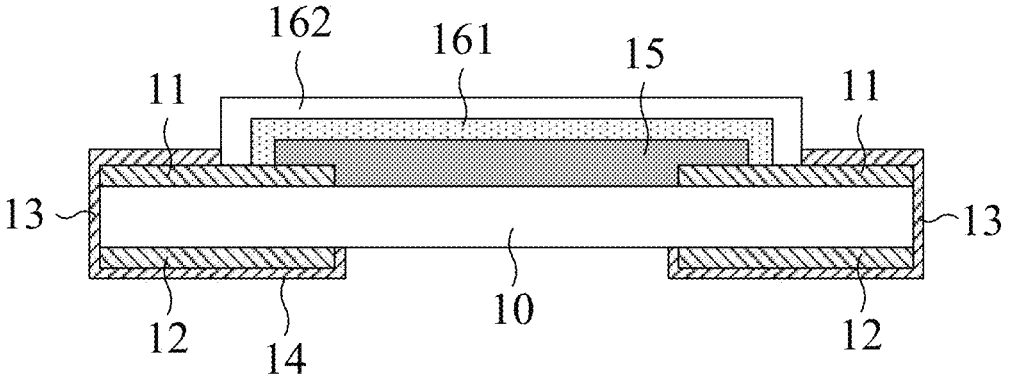
FIG. 1 (Related Art)
FIG. 1 is a schematic cross-sectional view of a chip resistor structure according to related art.
Figure 2A:
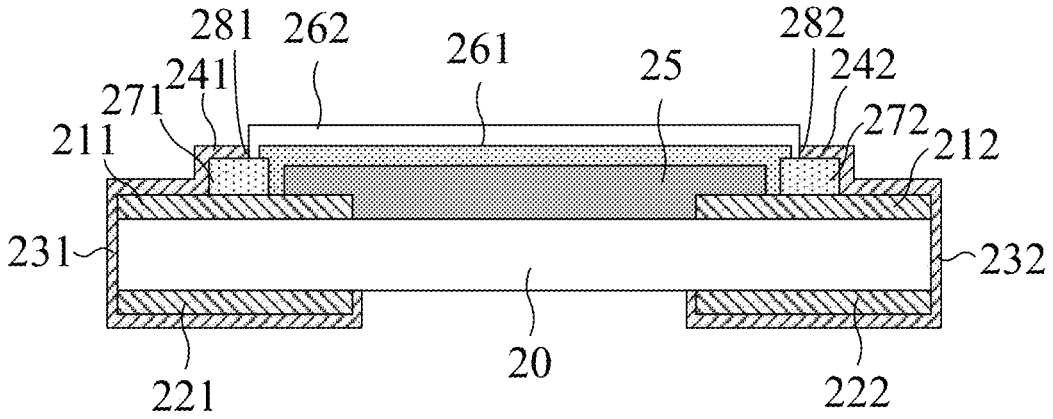
FIG. 2A is a schematic cross-sectional view of a chip resistor structure according to an embodiment of the present invention.
Figure 2B:
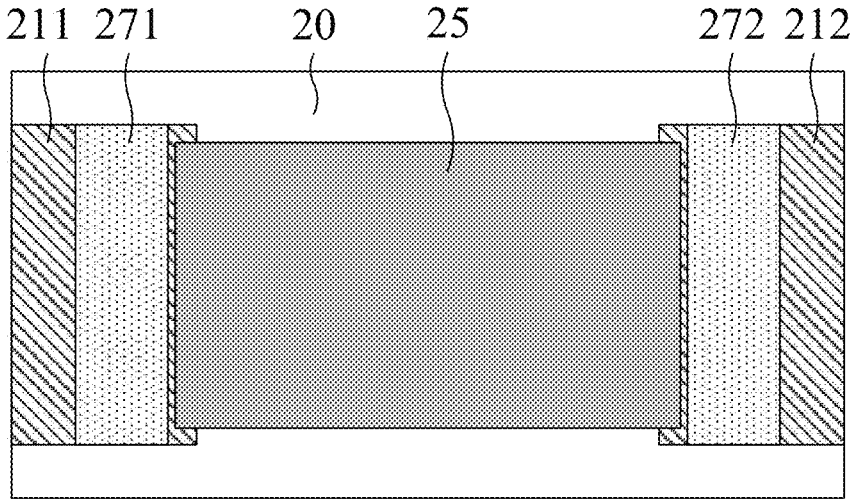
FIG. 2B is an exemplified top-plane view of the chip resistor structure illustrated in FIG. 2A while omitting the plating layers.

FIGS. 2A and 2B schematically illustrate a chip resistor structure according to an embodiment of the present invention, wherein FIG. 2A is a schematic longitudinal cross-sectional view of the chip resistor structure, and FIG. 2B is an exemplified top-plane view of the chip resistor. The chip resistor structure includes a substantially rectangular substrate 20, a pair of top electrodes 211 and 212, which are arranged opposite to each other on a top surface of the substrate 20 and have a specified interval therebetween; a pair of bottom electrodes 221 and 222, which are arranged opposite to each other on a bottom surface of the substrate 20 and have a specified interval therebetween; an end electrode 231, which conducts the top electrode 211 and the bottom electrode 221; an end electrode 232, which conducts the top electrode 212 and the bottom electrode 222; a resistance layer 25, which bridges the top electrodes 211 and 212; a first insulating layer 261 and a second insulating layer 262, which cover the resistance layer 25, wherein the second insulating layer 262 is used as an outer plating layer and covers the first insulating layer 261, which is used as an inner coating layer.

Please further refer to FIG. 2B, which illustrates an example of the chip resistor structure having the cross-sectional view as shown in FIG. 2A. In FIG. 2B, for clearly showing the relative relationship between the layers of interest in the chip resistor structure, the overlying first insulating layer 261 and second insulating layer 262 are omitted. The chip resistor structure in this example further includes spacer layers 271 and 272, which are respectively disposed above the top electrodes 211 and 212 to block environmental intrusions, and plating layers 241 and 242 overlying inner electrodes consisting of the top electrodes 211, 212, bottom electrodes 221, 222, and end electrodes 231, 232. As shown, the spacer layers 271 and 272 are disposed at opposite sides of the resistance layer 25 and interfaced with the first insulating layer 261. The opposite ends of the second insulating layer 262 extend beyond the first insulating layer 261 and partially overlie the spacer layers 271 and 272. Each of the plating layers 241 and 242 has one end extending to the bottom surface of the substrate 20, and the other end extending over one of the spacer layers 271 and 272. In this example, the plating layers 241 and 242 extend to the opposite side surfaces of the second insulating layer 262 on the upper surfaces of the spacer layers 271 and 272, and interfaces 281 and 282 exist at the junctions of the plating layers 241, 242 and two ends of the second insulating layer 262, respectively. It is to be noted that the interfaces 281 and 282 are disposed on or over the upper surfaces of the spacer layers 271 and 272 and kept away from the top electrodes 211 and 212 by way of the spacer layers 271 and 272, thereby preventing from the adverse effects of environmental intrusions on the top electrodes 211 and 212.

Figure 2C:
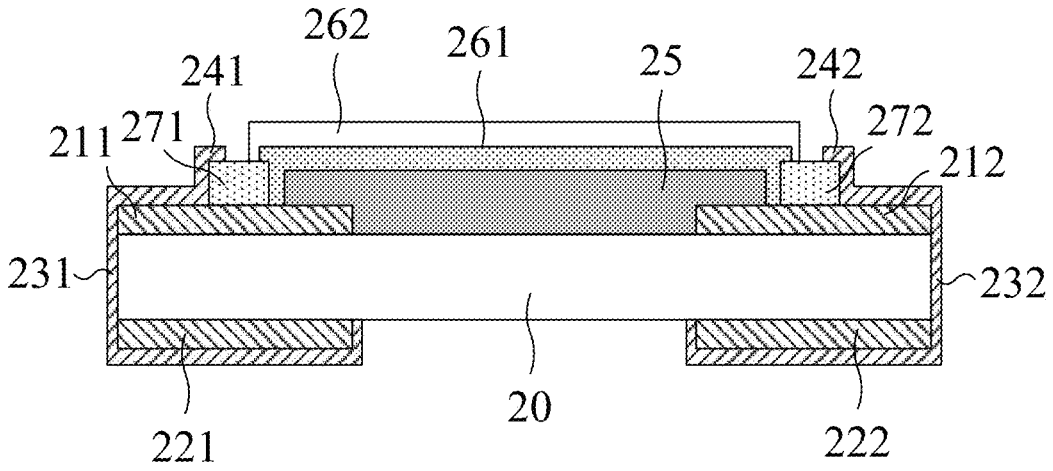
FIG. 2C is a schematic cross-sectional view of a chip resistor structure according to another embodiment of the present invention.
Figure 2D:
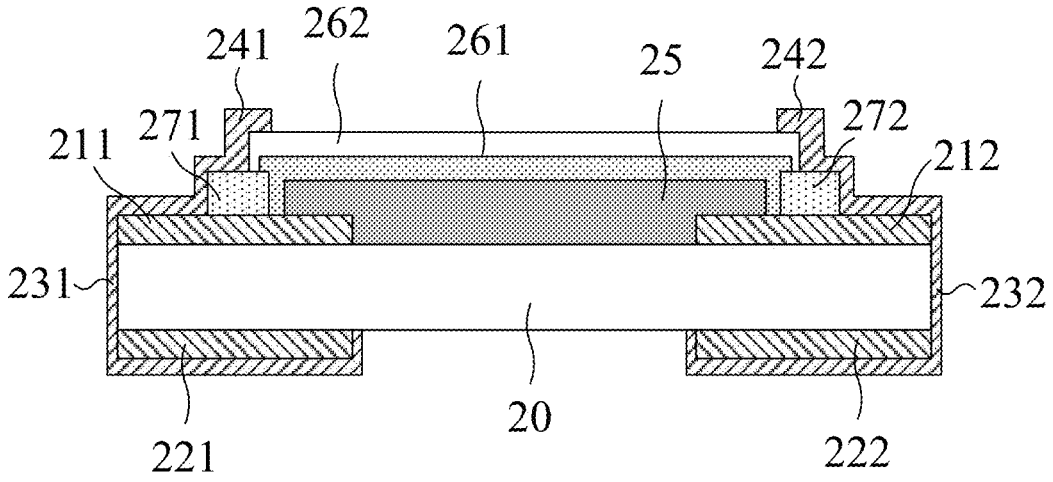
FIG. 2D is a schematic cross-sectional view of a chip resistor structure according to a further embodiment of the present invention.

For example, when the top electrodes are made of a material containing silver, the structural configuration as described above can prevent environmental intrusions such as sulfide gas or water vapor from coming into the chip resistor along the interfaces 281 and 282 and reacting with silver to generate compounds that may deteriorate the electronic properties of the chip resistor. In order to achieve the object of protecting the chip resistor, both the plating layers 241 and 242 are extended to the upper surface of the spacer layers 271 and 272 until encountering the second insulating layer 262 there. Of course, depending on practical requirements on resistance levels and manufacturing processes, the plating layers 241 and 242 and the second insulating layer 262 may be spaced apart rather than joining together on the upper surface of the spacer layers 271 and 272 (as shown in FIG. 2C). Alternatively, the plating layers 241 and 242 may further climb up to the second insulating layer 262 (as shown in FIG. 2D). The structural configuration of the chip resistor may be modified according to practical requirements as long as the spacer layers 271 and 272 can successfully block the environmental intrusions from reaching the top electrodes 211 and 212 without adversely affecting the features of the chip resistor, e.g., process feasibility, resistor performance, material compatibility, etc.

In the above embodiment, the substrate 20 may be, for example, a glass substrate, a ceramic substrate or made of any other suitable material depending on applications. Although the inner electrodes 211, 212, 221, 222, 231, 232 can be made of any material suitable for chip resistors, the chip resistor structure according to the present invention is particularly helpful when the electrodes are made of a material containing silver, nickel-copper alloy or copper. As known to those skilled in the art, such electrode materials are reactive to environmental chemicals, especially high-permeability gases or vapor, such as sulfide gas $H_2S$, $SO_2$, or moisture. For example, when the electrode material contains silver, the silver is likely to react with sulfur and form a compound with no conductivity or low conductivity. Therefore, for these electrode materials, the spacer layers of the present invention play a more important role to avoid contact and reaction of silver with sulfur. In this embodiment, the plating layers 241 and 242 may be nickel-tin layers. In a case that the end electrodes 231 and 232 are also made of materials consisting of nickel and tin, the plating layers 241 and 242 and the end electrodes 231 and 232 may be made integrally.

In the above embodiment, the plating layers 241, 242 are directly electroplated on the spacer layers 271, 272. In other words, in addition to the above-mentioned anti-sulfur and moisture-resistant properties, the material of the spacer layers 271, 272 may have an electroplatable property. Therefore, the plating layers 241 and 242 can be provided onto the spacer layers 271 and 272 by way of any suitable plating method, such as barrel plating. In another embodiment, the spacer layers 271 and 272 are not capable of being electroplated, and instead, an additional intermediate layer that is electroplatable can be provided on the spacer layers 271 and 272, so that the plating layers 241 and 242 can still be formed above the spacer layers 271 and 272.

Furthermore, the spacer layer may have a sheet resistance of 1 MΩ/□ or less. According to the research made by the present inventors, when the sheet resistance is less than 1MΩ/□, the resistance errors and the standard deviation of resistance errors can be reduced. In other words, the influence of the spacer layers on the resistance value of the chip resistor can be reduced.

Furthermore, the material used for forming the spacer layers have a sintering temperature as close to that for forming the top electrodes as possible. As known to those skilled in the art, in the manufacturing process of a chip resistor, a drying and sintering step is generally conducted after the electrode layers, resistance layer, and insulating layers are printed on the substrate 20. According to the research made by the present inventors, when the electrode contains silver, the sintering temperature is generally at a level of above 800 degrees Celsius, while the sintering temperature of the insulating layers is generally at a level of 200 degrees Celsius. Therefore, even if an attempt is made to extend the insulating layers to protect the electrodes from environmental intrusions, the insulating layers would have a problem of poor adhesion to the silver electrode layers due to the significant difference in sintering temperature, and could not achieve a satisfactory protection effect. On the contrary, by providing the spacer layers 271 and 272 between the insulating layer 262 and the top electrodes 211 and 212 according to the present invention, and selecting a proper material used for forming the spacer layers 271 and 272 to have a sintering temperature closer to that used for forming the electrodes 211 and 212, the adhesion capability is enhanced, and the protective effect is improved. Meanwhile, the relatively high sintering temperature is able to cause a relatively high denseness of the spacer layers 271 and 272, the undesirable migration of, for example, silver in the electrodes can also be prevented.

In order to exhibit the above functions, an example of the material having an electroplatable property and used for forming the spacer layers may be a metal, a metal alloy or a compound formed with a metal, e.g., a metal oxide. Other examples may include aluminum, aluminum alloys, nickel, nickel alloys, titanium, chromium, carbon, ruthenium dioxide, etc.

Figure 3A:
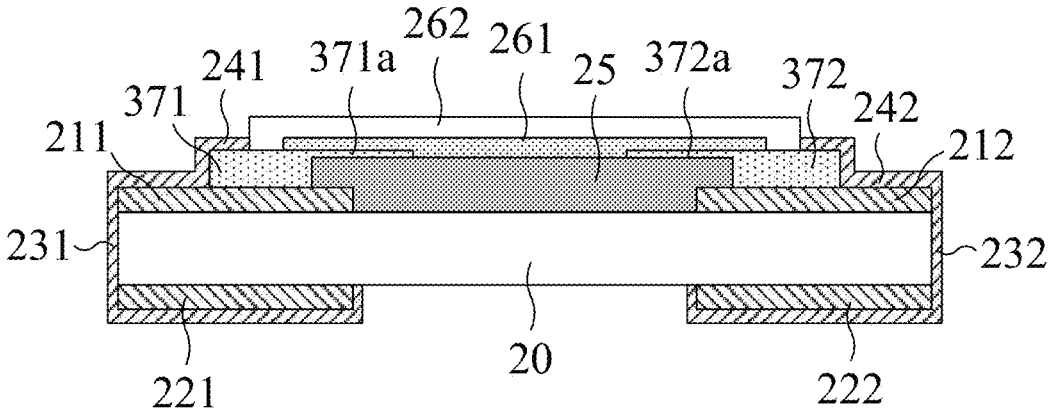
FIG. 3A is a schematic cross-sectional view of a chip resistor structure according to another embodiment of the present invention.
Figure 3B:
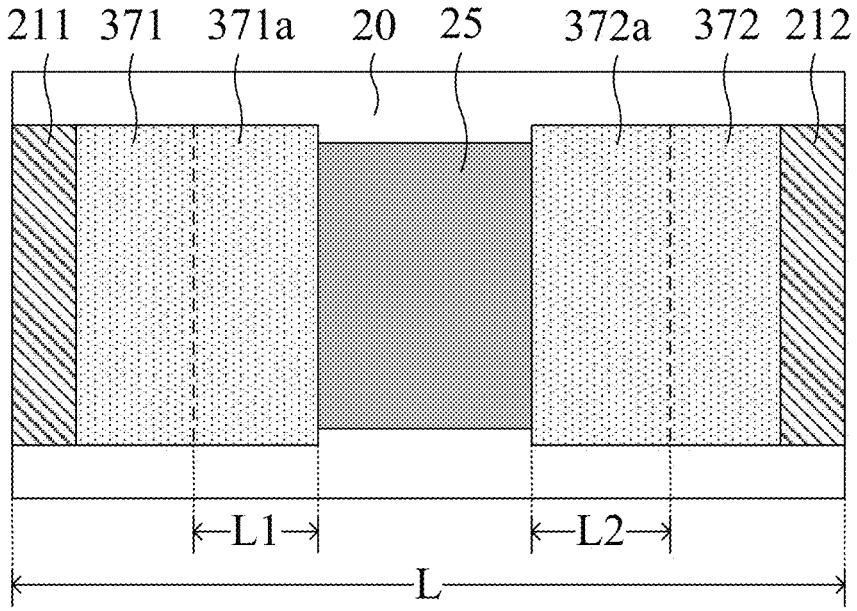
FIG. 3B is an exemplified top-plane view of the chip resistor structure illustrated in FIG. 3A while omitting the plating layers.

FIGS. 3A and 3B schematically illustrate a chip resistor structure according to another embodiment of the present invention, wherein FIG. 3A is a schematic longitudinal cross-sectional view of the chip resistor structure, and FIG. 3B is an exemplified top-plane view of the chip resistor. Materials of the substrate 20, the top electrodes 211 and 212, the bottom electrodes 221 and 222, the end electrodes 231 and 232, the resistance layer 25, the first insulating layer 261, the second insulating layer 262, and the plating layers 241 and 242 of the chip resistor structure used in the embodiments illustrated with reference to FIGS. 2A and 2B as above can be used in this embodiment. In addition, the structural configuration of the chip resistor similar to that shown in FIGS. 2A and 2B will not be redundantly described herein. Of course, those who are skilled in the art can also make adaptive modifications to fit different applications.

Furthermore, the chip resistor in this embodiment also includes spacer layers 371 and 372, which can be made of the same material as the spacer layers 271, 272 in the embodiment shown in FIGS. 2A and 2B, but have different structural configuration.

Please refer to FIG. 3B. In this embodiment, the spacer layers 371 and 372 formed on the top electrodes 211 and 212, respectively, extend up to the upper surfaces of the two ends of the resistance layer 25. By extending up to the resistive layer 25, the interval between the spacer layers 371 and 372 becomes shorter, compared with that between the spacer layers 271 and 272, so the two spacer layers 371 and 372 can be aligned better to avoid the resistance variation caused by misalignment. In this embodiment, the size and shape of overlapping portions 371*a* and 372*a* of respective spacer layers 371 and 372 on the resistive layer 25 may be designed to prevent from environmental intrusions and misalignment, while exhibiting anti-migration capability and appropriate temperature coefficient of resistance (TCR). According to the research made by the present inventors, the anti-migration capability of the spacer layers 371 and 372 would undesirably lower with the reduction of the interval between the overlapping portions 371*a* and 372*a* of respective spacer layers 371 and 372 on the resistive layer 25. Further, the TCR value would undesirably increase with the increase of the interval between the overlapping portions 371*a* and 372*a*. Therefore, it is necessary to make a trade off between the above-mentioned conditions. In this embodiment, a sum of respective lengths L1 and L2 of the overlapping portions 371*a* and 372*a* may be 12%-21% of the length L of the chip resistor.

Figure 3C:
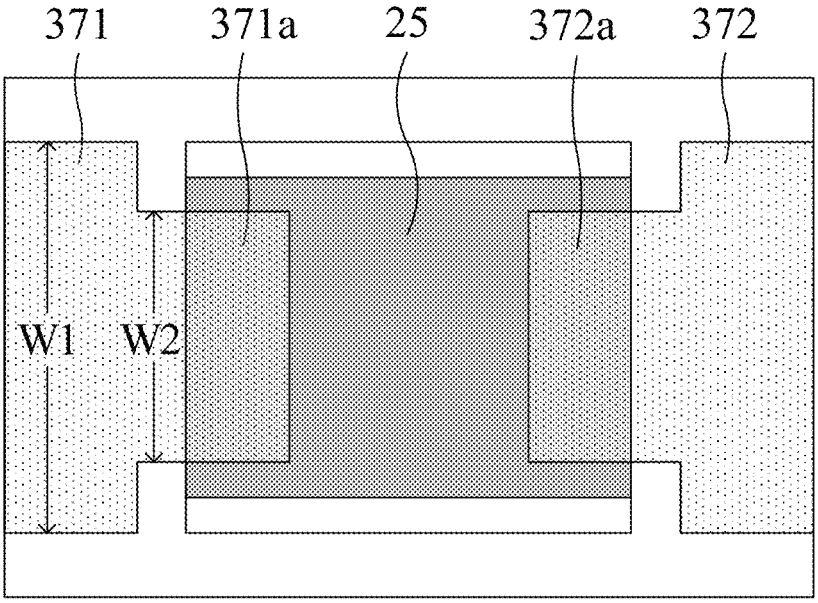
FIG. 3C is another exemplified top-plane view of the chip resistor structure illustrated in FIG. 3A while omitting the plating layers.

In another example as shown in FIG. 3C, the width W1 of the spacer layers 371 and 372 may be reduced to a width W2 at the overlapping portions 371*a* and 372*a*, which may be also less than the width of the resistance layer 25. In other words, the spacer layers 371 and 372 are each designed in a convex shape. The actual size thereof can be changed according to practical needs by those skilled in the art. In this manner, the spacer layers with satisfactory anti-migration ability and temperature coefficient of resistance can be provided.

Figure 4A:
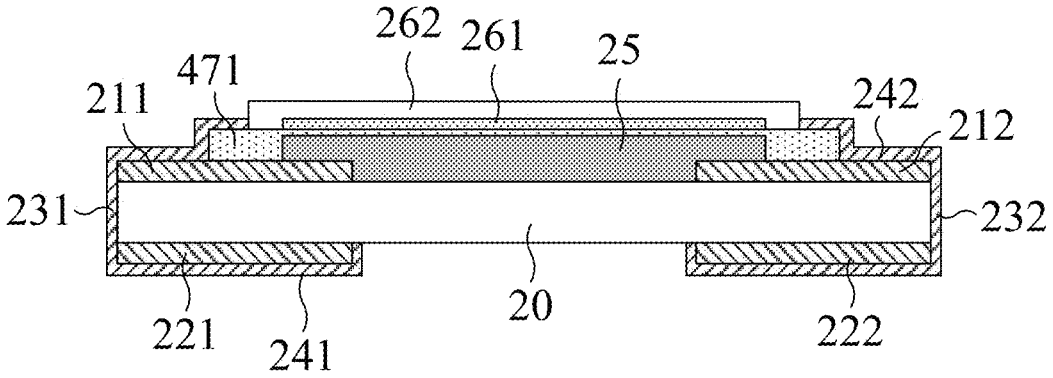
FIG. 4A is a schematic cross-sectional view of a chip resistor structure according to a further embodiment of the present invention.
Figure 4B:
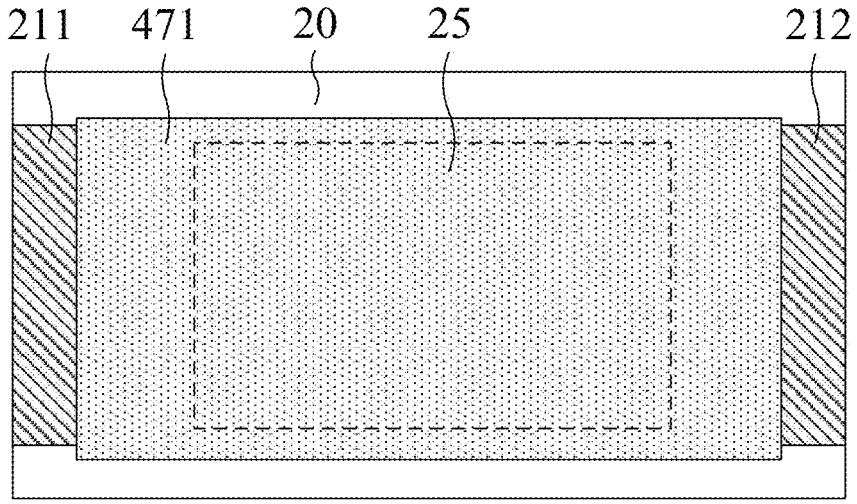
FIG. 4B is an exemplified top-plane view of the chip resistor structure illustrated in FIG. 4A while omitting the plating layers.

FIGS. 4A and 4B schematically illustrate a chip resistor structure according to a further embodiment of the present invention, wherein FIG. 4A is a schematic longitudinal cross-sectional view of the chip resistor structure, and FIG. 4B is an exemplified top-plane view of the chip resistor. Materials of the substrate 20, the top electrodes 211 and 212, the bottom electrodes 221 and 222, the end electrodes 231 and 232, the resistance layer 25, the first insulating layer 261, the second insulating layer 262, and the plating layers 241 and 242 of the chip resistor structure used in the embodiments illustrated with reference to FIGS. 2A and 2B as above can be used in this embodiment. In addition, the structural configuration of the chip resistor similar to that shown in FIGS. 2A and 2B will not be redundantly described herein. Of course, those who are skilled in the art can also make adaptive modifications to fit different applications.

Furthermore, the chip resistor in this embodiment also includes a spacer layer 471, which can be made of the same material as the spacer layers 271, 272 in the embodiment shown in FIGS. 2A and 2B, but have different structural configuration.

Please refer to FIG. 4B. In this embodiment, the spacer layer 471 disposed on the top electrodes 211 and 212 and the resistance layer 25 extends from the top electrode 211 through the resistance layer 25 to the top electrode 212. Therefore, possible problems caused by misalignment of separate spacer layers can be eliminated. Furthermore, the spacer layer can be applied relatively readily and reliably, and is suitable adopted for high-resistance chip electronics.

In an embodiment, a material containing ruthenium dioxide ($RuO_2$) may be suitably used as the material of both the resistance layer 25 and the spacer layer 471. In this case, to minimize the influence of the spacer layer 471 on the resistance value of the resistance layer 25, the resistance value of the spacer layer 471 is made less than the resistance value of the resistance layer 25 by having a content of ruthenium dioxide ($RuO_2$) in the spacer layer 471 lower than a content of ruthenium dioxide ($RuO_2$) in the resistance layer 25. For example, it is made at least 8% lower.

The performance of the chip resistors according to the present invention can be verified by being applied to a sulfuration test, which is conducted by way of immersion in 105° C./3.5 wt % wet sulfur environment in a bare chip form. According to the research made by the inventors, the resistance change of the chip resistors according to the present invention is as little as below 1% after 1000-hours stay in the sulfur environment, which is much better than the 500-hours industry standard.

In summary, by providing a spacer layer as described above on or above a top electrode, environmental intrusions can be blocked. Thus, the undesired reaction between the environmental intrusions and the top electrodes can be avoided.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A chip resistor structure, comprising:

a substrate;

a pair of first electrodes disposed opposite to each other on a first surface of the substrate at a first interval;

a resistance layer disposed between the pair of first electrodes on the first surface, and having two opposite ends extending over the pair of first electrodes, respectively;

a spacer layer made of a material having a composition different from that of the resistance layer, disposed over the pair of first electrodes, and including a first portion and a second portion extending from the pair of first electrodes over the two opposite ends of the resistance layer, respectively, wherein a length of the second portion is in a range of 12% to 21% length of the chip resistor structure, and each of the first portion and the second portion of the spacer layer has a first width less than a width of the resistance layer covered thereby;

a protective layer overlying the resistance layer; and a plating layer electroplated onto the pair of first electrodes and the spacer layer, and having ends extending beyond the pair of first electrodes terminate at least over the spacer layer.

2. The chip resistor structure according to claim 1, wherein each of the first portion and the second portion of the spacer layer has a second width not less than a width of the pair of first electrodes covered thereby.

3. The chip resistor structure according to claim 1, wherein the first portion and the second portion of the spacer layer are integrally formed as a contiguous layer on the resistance layer.

4. The chip resistor structure according to claim 1, wherein the plating layer and the protective layer encounter each other over the spacer layer, and any interface or gap between the plating layer and the protective layer is spaced from the pair of first electrodes with the spacer layer.

5. The chip resistor structure according to claim 1, wherein compared with a material of the protective layer, the material of the spacer layer has a sintering temperature closer to a sintering temperature of the pair of first electrodes.

6. The chip resistor structure according to claim 1, wherein the material of the spacer layer is an electroplated material.

7. The chip resistor structure according to claim 6, wherein the electroplated material is selected from a group consisting of aluminum, nickel, titanium, chromium, carbon, ruthenium, an alloy thereof, an oxide thereof, and a combination thereof.

8. The chip resistor structure according to claim 6, wherein the material of the spacer layer contains ruthenium dioxide.

9. The chip resistor structure according to claim 1, wherein a material of the resistance layer contains a compound selected from a group consisting of ruthenium dioxide, silicon dioxide, barium oxide, zinc oxide, silver, silver palladium alloy, and a combination thereof.

10. The chip resistor structure according to claim 1, further comprising a pair of second electrodes disposed opposite to each other on a second surface of the substrate, wherein the first surface is a top surface of the substrate and the second surface is a bottom surface of the substrate; and a pair of third electrodes, each disposed on one end surface of the substrate, and electrically connecting one of the pair of first electrodes to one of the pair of second electrodes.

11. The chip resistor structure according to claim 10, wherein the plating layer is further electroplated onto the pair of second electrodes and the pair of third electrodes.

12. The chip resistor structure according to claim 10, wherein the pair of first electrodes, the pair of second electrodes and the pair of third electrodes are made of a silver-based paste, a copper-nickel-alloy-based paste or a copper-based paste.

13. The chip resistor structure according to claim 1, wherein the pair of first electrodes are made of a silver-based paste.

14. The chip resistor structure according to claim 1, wherein the protective layer includes a lower insulating layer overlying the resistance layer, and an upper insulating layer overlying the lower insulating layer and having the ends extending beyond the pair of first electrodes terminating over the spacer layer.

15. A chip resistor structure, comprising:

a substrate;

a pair of first electrodes disposed opposite to each other on a first surface of the substrate at a first interval;

a resistance layer disposed between the pair of first electrodes on the first surface, and having two opposite ends extending over the pair of first electrodes, respectively;

a spacer layer made of a material having a composition different from that of the resistance layer, disposed over the pair of first electrodes, and including a first portion and a second portion extending from the pair of first electrodes over the two opposite ends of the resistance layer, respectively, while being in contact with the resistance layer;

a protective layer overlying the resistance layer; and a plating layer electroplated onto the pair of first electrodes and the spacer layer, and having ends extending beyond the pair of first electrodes terminate at least over the spacer layer.

16. The chip resistor structure according to claim 15, wherein both the material of the resistance layer and the spacer layer contains ruthenium dioxide, and a content of ruthenium dioxide in the spacer layer is less than a content of ruthenium dioxide in the resistance layer.

17. A chip resistor structure, comprising:

a substrate;

a pair of first electrodes disposed opposite to each other on a first surface of the substrate at a first interval;

a resistance layer disposed between the pair of first electrodes on the first surface and having two opposite ends extending over the pair of first electrodes, respectively;

a spacer layer made of a material having a composition different from that of the resistance layer, disposed over the pair of first electrodes, and including a first portion and a second portion extending from the pair of first electrodes over the two opposite ends of the resistance layer, respectively, wherein each of the first portion and the second portion of the spacer layer has a first width less than a width of the resistance layer covered thereby;

a protective layer overlying the resistance layer; and a plating layer electroplated onto the pair of first electrodes and the spacer layer, and having ends extending beyond the pair of first electrodes terminate at least over the spacer layer.

* * * * *